US009075361B2

(12) United States Patent
Okuma et al.

(10) Patent No.: US 9,075,361 B2
(45) Date of Patent: Jul. 7, 2015

(54) FIXING DEVICE AND IMAGE FORMING APPARATUS PROVIDED THEREWITH

(71) Applicant: KYOCERA Document Solutions Inc., Osaka (JP)

(72) Inventors: Kohei Okuma, Osaka (JP); Keiichi Tanida, Osaka (JP); Satoshi Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/225,744

(22) Filed: Mar. 26, 2014

(65) Prior Publication Data

US 2014/0294469 A1 Oct. 2, 2014

(30) Foreign Application Priority Data

Mar. 26, 2013 (JP) ..... 2013-064500

(51) Int. Cl.
*G03G 17/08* (2006.01)
*G03G 15/20* (2006.01)

(52) U.S. Cl.
CPC ..... *G03G 15/2053* (2013.01); *G03G 15/2064* (2013.01); *G03G 15/2007* (2013.01); *G03G 15/2017* (2013.01)

(58) Field of Classification Search
CPC ..... G03G 15/2007; G03G 15/2017; G03G 15/2053
USPC ..... 399/330, 333
See application file for complete search history.

(56) References Cited

U.S. PATENT DOCUMENTS

| | | | | |
|---|---|---|---|---|
| 4,544,828 | A * | 10/1985 | Shigenobu et al. | 219/216 |
| 4,780,078 | A * | 10/1988 | Masui | 432/60 |
| 6,345,169 | B1 * | 2/2002 | Haneda et al. | 399/328 |
| 2002/0051663 | A1 * | 5/2002 | Kinouchi et al. | 399/330 |

FOREIGN PATENT DOCUMENTS

| | | |
|---|---|---|
| JP | 2012-47790 | 3/2012 |

* cited by examiner

*Primary Examiner* — Benjamin Schmitt
(74) *Attorney, Agent, or Firm* — Knobbe, Martens, Olson & Bear LLP

(57) ABSTRACT

A fixing device includes: a heat source, a heating member, a pressure member, a heat absorption unit, a holding member, and an end part supporting member. The heat source generates infrared rays. The heat absorption unit is formed on an inner circumferential surface of the heating member, absorbs radiation heat of the heat source, and opposes an outer circumferential part of the holding member with a gap. The holding member has a hollow and cylindrical shape, and arranged between the heat source and the inner circumferential surface of the heat member, permits transmission of infrared rays and has heat resistance. The end part supporting member supports the holding member at both axial end parts of the heating member. The outer circumferential part of the holding member, the inner circumferential surface of the heating member, and the end part supporting member form a sealing space sealing the heat absorption unit.

9 Claims, 4 Drawing Sheets

FIXING DEVICE AND IMAGE FORMING APPARATUS PROVIDED THEREWITH

INCORPORATION BY REFERENCE

This application claims priority to Japanese Patent Application No. 2013-64500 filed on 26 Mar. 2013, the entire contents of which are incorporated by reference herein.

BACKGROUND

This disclosure relates to a fixing device used in an image forming apparatus such as a copier, a printer, a facsimile, or a composite machine including them, and the image forming apparatus provided with such a fixing device. This disclosure more specifically relates to a technology of preventing ultra particles generated inside the fixing device from diffusing to outside of the fixing device.

In an image forming apparatus adopting an electrophotographic method, a toner is provided to an electrostatic latent image formed on a photo conductor to form a toner image, the toner image is transferred onto paper, and then the toner image on the paper is fixed by a fixing device.

In a fixing device of a heating type that heats paper to thereby fix a toner image onto the paper, ultrafine particles (UFP) generated due to the aforementioned heating may diffuse inside the image forming apparatus. In recent years, in response to a rise in the awareness of environmental problems, there have been demands for suppressing diffusion of the ultrafine particles (UFP) to outside of the apparatus. The ultrafine particles (UFP) refer to, of suspended particulate matters (SPM), particles with a diameter of 100 nm or below. It has been found that the ultrafine particles (UFP) are generated mainly from silicon rubber used as an elastic layer of, for example, a heat roller. That is, as a result of heating of the silicon rubber, low-molecular siloxane is generated and this low-molecular siloxane is diffused as ultrafine particles (UFP).

Thus, technologies of removing the ultrafine particles (UFP) are known. For example, there is a fixing device provided with an ultrafine particles remover having an absorbing fan, a dust collecting filter, and a duct. After an air flow flows through the duct from vicinity of a side surface of a fixing roller by the absorbing fan, it is discharged to outside of the image forming apparatus via the dust collecting filter, but the ultrafine particles (UFP) generated from the heat roller having the elastic layer of the silicon rubber flow through the duct together with the air flow by the absorbing fan, and are captured by the dust collecting filter. As a result, the ultrafine particles (UFP) are never discharged to the outside of the image forming apparatus.

It has been found that the ultrafine particles (UFP) are generated from not only the silicon rubber used for an elastic layer of the heat roller or a pressure roller but also a heat absorption unit formed on an inner circumferential surface of the heat roller. For example, in order to efficiently absorb heat of a heat source and transmit it to the heat roller, for the heat absorption unit, a black paint such as Celmo black, Okitomo Paint, or Tetzsol (all of which are product names) is used. These black paints are generated by adding modified silicon to metal oxide. An increase in a temperature of the heat absorption unit by the heat source raises a problem that siloxane is generated from the modified silicon of the heat absorption unit and this siloxane diffuses as ultrafine particles (UFP).

SUMMARY

As one aspect of this disclosure, a technology achieved by further improving the aforementioned technology has been suggested.

A fixing device according to one aspect of this disclosure includes: a heat source, a heating member, a pressure member, a heat absorption unit, a holding member, and an end part supporting member.

The heat source generates infrared rays and is disposed at a hollow part of the holding member.

The heat absorption unit is formed on an inner circumferential surface of the heating member, absorbs radiation heat of the heat source, and opposes an outer circumferential part of the holding member with a gap in-between.

The holding member is of a hollow, cylindrical shape, is arranged between the heat source and the inner circumferential surface of the heat member, permits transmission of infrared rays therethrough and has heat resistance.

The end part supporting member supports the holding member at both axial end parts of the heating member.

The outer circumferential part of the holding member, the inner circumferential surface of the heating member, and the end part supporting member form a sealing space sealing the heat absorption unit.

An image forming apparatus according to another aspect of this disclosure includes: an image formation unit, and the fixing device described above.

The image formation unit forms a toner image on a recording medium.

The fixing device fixes, on the recording medium, the toner image formed by the image formation unit.

DETAILED DESCRIPTION

Hereinafter, a fixing device and an image forming apparatus according to embodiments as one aspect of this disclosure will be described with reference to the drawings.

Hereinafter, the embodiments of this disclosure will be described with reference to the drawings, but this disclosure is not limited to these embodiments. Moreover, usage of the disclosure, terms shown herein, etc. are not limited to them.

First Embodiment

Figure 1:
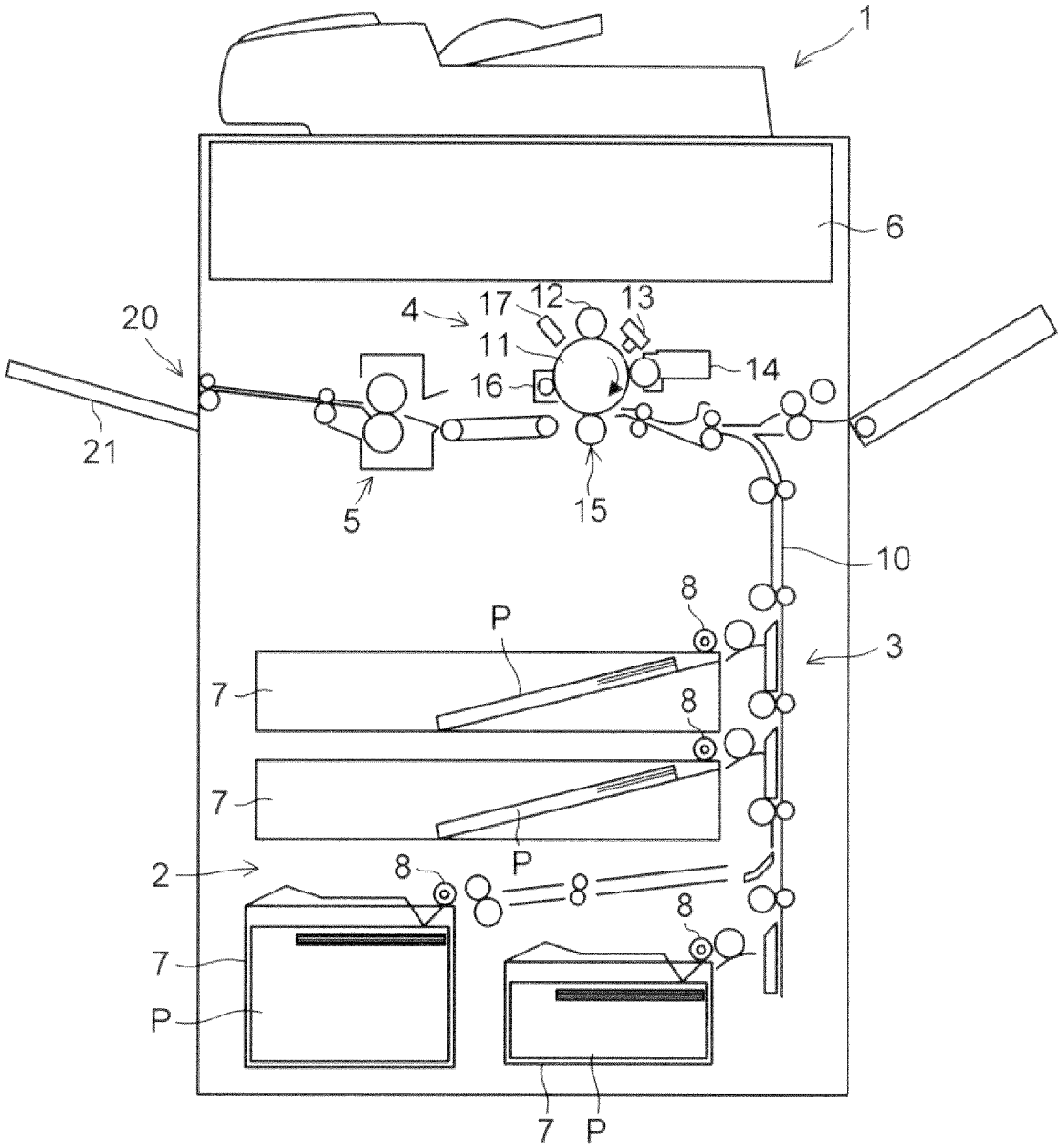
FIG. 1 is a sectional view showing an image forming apparatus provided with a fixing device according to a first embodiment of this disclosure.

FIG. 1 is a sectional view showing configuration of the image forming apparatus provided with the fixing device according to the embodiments of this disclosure. The image forming apparatus 1 includes: a paper feed unit 2 disposed at a bottom part thereof a paper conveyance unit 3 disposed on a side of the paper feed unit 2; an image formation unit 4 disposed above the paper conveyance unit 3; a fixing device 5 disposed closer to a paper discharge side than the image formation unit 4; and an image reading unit 6 disposed above the image formation unit 4 and the fixing device 5.

The paper feed unit 2 includes a plurality of paper feed cassettes 7 storing paper P as a recording medium, and through rotation of a paper feed roller 8, individually delivers the paper P to the paper conveyance unit 3 from the paper feed cassette 7 selected from among the plurality of paper feed cassettes 7.

The paper P delivered to the paper conveyance unit 3 is conveyed toward the image formation unit 4 via a paper conveyance path 10 included in the paper conveyance unit 3. The image formation unit 4, through an electrophotographic process, forms a toner image on the paper P, and includes: a photo conductor 11 supported in a manner such as to be rotatable in an arrow direction of FIG. 1; and a charging unit 12, a exposing unit 13, a developing unit 14, a transfer unit 15, a cleaning unit 16, and a neutralization unit 17, which are provided around the photo conductor 11 along a rotation direction thereof.

The charging unit 12 includes a charge roller to which a high voltage is applied, and when predetermined potential is given to a surface of the photo conductor 11 from the charge roller in contact with the surface of the photo conductor 11, the surface of the photo conductor 11 is uniformly charged. Then light based on image data of a document read by the image reading unit 6 is irradiated from the exposing unit 13 to the photo conductor 11, upon which the surface potential of the photo conductor 11 is selectively attenuated, and an electrostatic latent image is formed on the surface of the photo conductor 11.

The developing unit 14 develops the electrostatic latent image on the surface of the photo conductor 11, whereby a toner image is formed on the surface of the photo conductor 11. This toner image is transferred by the transfer unit 15 onto the paper P conveyed between the photo conductor 11 and the transfer unit 15.

The paper P on which the toner image has been transferred is conveyed towards the fixing device 5 arranged on a downstream side of the image formation unit 4 in a paper conveyance direction. The paper P is heated and pressurized in the fixing device 5, and the toner image on the paper P is melted and fixed. The paper P on which the toner image has been fixed is discharged onto a discharge tray 21 by a discharge roller pair 20.

After the toner image transfer onto the paper P by the transfer unit 15, a toner remaining on the surface of the photo conductor 11 is removed by the cleaning unit 16, and electric charges remaining on the surface of the photo conductor 11 are removed by the neutralization unit 17. Then the photo conductor 11 is charged again by the charging unit 12, and image formation is performed thereafter in the same manner.

Figure 2:
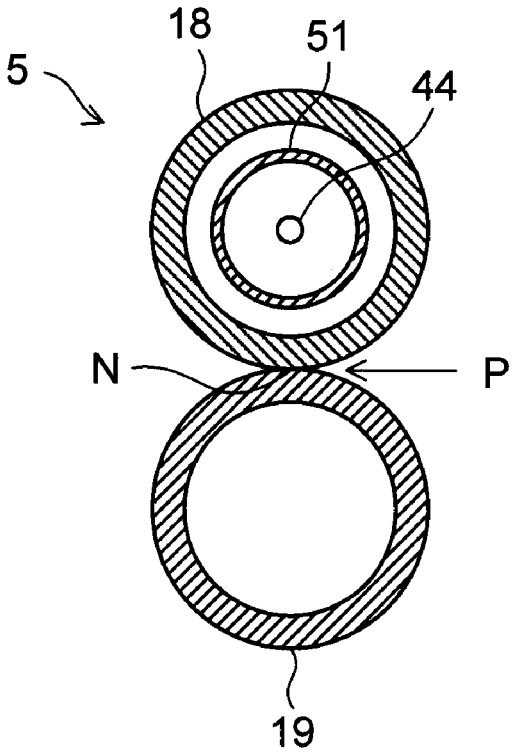
FIG. 2 is a side sectional view showing the fixing device according to the first embodiment.
Figure 3:
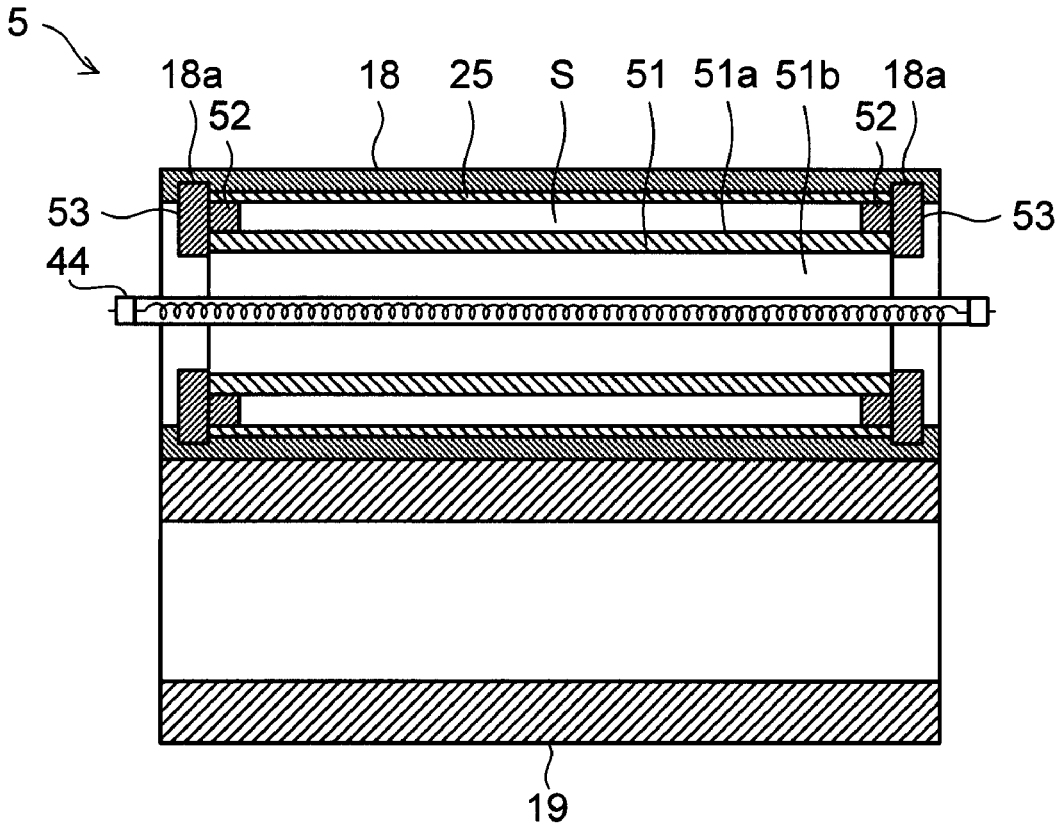
FIG. 3 is a longitudinal sectional view showing the fixing device according to the first embodiment.

FIGS. 2 and 3 are a side sectional view and a longitudinal sectional view (a sectional view perpendicular to a paper surface of FIG. 2) showing the fixing device 5 used in the aforementioned image forming apparatus 1.

As shown in FIG. 2, the fixing device 5 adopts a roller fixation method, and includes: a heat roller 18 as a heating member; a pressure roller 19 as a pressure member; a heater 44 as a heat source; and a holding member 51.

Used as the heat roller 18 is the one obtained by covering, with a fluorine resin coating or tube, a top of a cylindrically-shaped core bar of metal such as aluminum or iron with excellent heat conductance. Provided inside the core bar of the heat roller 18 is a heater 44, such as a halogen lamp or a xenon lamp, which generates radiation heat.

Used as the pressure roller 19 is the one obtained by forming an elastic layer of, for example, silicon rubber on a cylindrically-shaped base material formed of synthetic resin, metal, and other materials and then covering a surface of this elastic layer with a fluorine resin coating.

The pressure roller 19 is pressure-welded to the heat roller 18 with a predetermined pressure. When the heat roller 18 is driven into rotation by a motor (not shown), the pressure roller 19 rotates following the rotation of the heat roller 18. At a portion where the heat roller 18 and the pressure roller 19 make contact with each other while rotating oppositely to each other, a nip part N is formed. Configuration such that the pressure roller 19 is driven into rotation by the motor and the heat roller 18 rotates following the aforementioned rotation is also permitted.

The paper P is conveyed from an upstream side in the paper conveyance direction (right side of FIG. 2) to the nip part N, and it is heated and pressurized by the heat roller 18 and the pressure roller 19 at the nip part N, whereby a toner in a powdery state on the paper P is thermally melted and fixed. The paper P after the fixation treatment is separated from a surface of the heat roller 18 by a separation claw (not shown), and is then conveyed to a downstream side of the fixing device 5 in the paper conveyance direction.

As shown in FIG. 3, on an inner circumferential surface of the heat roller 18, a heat absorption unit 25 is formed. In an axial direction of the heat roller 18, the heat absorption unit 25 has a length equal to or longer than a width of the paper P which is inserted into the nip part N (see FIG. 2), and is formed on an entire circumference of the inner circumferential surface of the heat roller 18. Moreover, the heat absorption unit 25 is formed of a black paint (for example, Okitumo Paint No. 8264: product name) that is burnt into the inner circumferential surface of the heat roller 18. By applying the black paint to the inner circumferential surface of the metallic heat roller 18 heated by the heater 44, an absorption rate of infrared rays generated from the heater 44 increases, as a result of which an absorption rate of the radiation heat of the heater 44 can be improved and the radiation heat can be transmitted to the heat roller 18.

The heat absorption unit 25 (black paint) is generated by adding modified silicon to metallic oxide. When a temperature of the heat absorption unit 25 is increased by the heater 44, siloxane is generated from the modified silicon of the heat absorption unit 25, and the siloxane diffuses as ultrafine particles (UFP) to surroundings of the heat absorption unit 25.

In order to prevent the ultrafine particles (UFP) from diffusing from the heat absorption unit 25 to outside of the fixing device 5, in this embodiment, a sealed space S is formed at the surroundings of the heat absorption unit 25 to close the ultrafine particles (UFP) inside the sealed space S.

The sealed space S is formed by: the inner circumferential surface of the heat roller 18 (surface on which the heat absorption unit 25 is formed); an outer circumferential part 51*a* of the holding member 51; and O ring 52 as an end part supporting members.

The holding member 51 is formed of a material, for example, silica glass which permits transmission of infrared rays therethrough and which has heat resistance to 300 degrees Celsius or above. The holding member 51 is formed into a hollow, cylindrical shape with a length equal to or longer than that of the heat absorption unit 25 in the axial direction of the heat roller 18. The outer circumferential part 51*a* of the holding member 51 opposes the heat absorption unit 25 with a predetermined gap therebetween. At a hollow part 51*b* of the holding member 51, the heater 44 is disposed. Therefore, the infrared rays generated from the heater 44 are transmitted through the holding member 51 and absorbed by the heat absorption unit 25, whereby the radiation heat of the heater 44 is efficiently transmitted to the heat roller 18. Note that, if the holding member 51 is of a material which permits transmission of the infrared rays of the heater 44 therethrough and which has heat resistance to a heat of 300 degrees Celsius or above of the heater 44, it may be of not silica glass, but an inorganic material such as glass that contains a component other than silica dioxide. Moreover, in a case where there is a risk that the heater 44 overshoots on a high-temperature side, it is preferable that the holding member 51 have heat resistance to 400 degrees Celsius or above.

The O ring 52 is formed into a toric shape with an elastic material such as rubber, and is disposed at both axial end parts of the holding member 51. The O ring 52 makes pressure-contact with the outer circumferential part 51*a* of the holding member 51 and the inner circumferential surface of the heat roller 18. Note that the O ring 52 may be of a rectangular shape or a circular shape in sectional view.

On outer sides of the O rings 52 (axial end part sides of the holding member 51), a pair of snap rings 53 are disposed. The snap ring 53 is formed of a metal plate formed into a C shape in planar view, and is inserted by its elasticity into a circular grove 18*a* provided on the inner circumferential surface of the heat roller 18. As a result of inserting the snap rings 53 into the circular groove 18*a* of the heat roller 18, axial end surfaces of the holding member 51 and outer side surfaces of the O rings 52 make contact with the snap rings 53, and the holding member 51 and the O ring 52 are axially supported at predetermined positions.

As a result the outer circumferential part 51*a* of the holding member 51 and the inner circumferential surface of the heat roller 18 are brought into pressure-contact with the O rings 52, the sealed space S is formed.

Therefore, even when the temperature of the heat absorption unit 25 is increased by the heater 44 and the ultrafine particles (UFP) are generated from the heat absorption unit 25, the ultrafine particles (UFP) are sealed in the sealed space S and do not diffuse to the outside of the fixing device 5. Since the sealed space S has a predetermined width that permits storage of the ultrafine particles (UFP), use of, for example, a dust collecting filter that captures the ultrafine particles (UFP) is not required, cumbersome operation such as dust collecting filter replacement does not have to be performed, and apparatus configuration also becomes simple.

Second Embodiment

Figure 4:
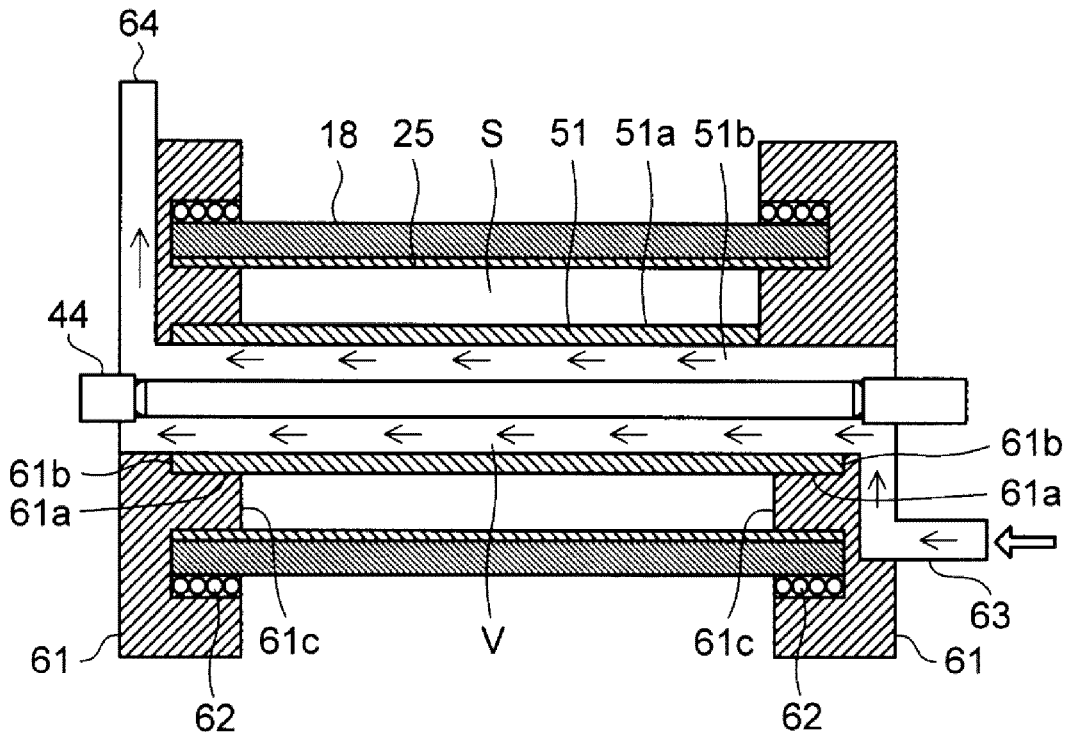
FIG. 4 is a sectional view showing a heating member used in a fixing device according to a second embodiment of this disclosure.

FIG. 4 is a sectional view, axially cutting a heat roller 18 used in the fixing device 5 as the second embodiment of this disclosure. In the second embodiment, a flow passage V is formed inside the heat roller 18 where the sealed space S is formed. Configuration of surroundings of the heat roller 18 that is different from that of the first embodiment will be described and a description of portions identical to those of the first embodiment will be omitted below.

The heat roller 18 is rotatably supported by frame bodies 61 with bearing parts 62 in between. The heat absorption unit 25 is formed around entire circumference of an inner circumferential surface of the heat roller 18 rotatably supported by the frame bodies 61 described above.

A sealed space S is formed by: the inner circumferential surface (surface where the heat absorption unit 25 is formed) of the heat roller 18; an outer circumferential part 51*a* of a holding member 51; and the frame bodies 61 as end part supporting members.

The frame bodies 61 are disposed on both axial end parts of the holding member 51, rotatably support the heat roller 18, and also axially support the holding member 51 at a predetermined position. The frame bodies 61 fit at its fitting part 61*a* into the outer circumferential part 51*a* of the holding member 51 to support the holding member 51, and make its end part contact part 61*b* in contact with an end surface of the holding member 51 to support the holding member 51. With this configuration, the sealed space S is formed by the outer circumferential part 51*a* of the holding member 51, the inner circumferential surface of the heat roller 18, and side surface parts 61*c* of the frame bodies 61.

Therefore, even when the temperature of the heat absorption unit 25 is increased by the heater 44 and the ultrafine particles (UFP) are generated from the heat absorption unit 25, the ultrafine particles (UFP) are sealed in the sealed space S and do not diffuse to the outside of the fixing device 5. Since the sealed space S has a predetermined width that permits storage of the ultrafine particles (UFP), use of, for example, a dust collecting filter that captures the ultrafine particles (UFP) is not required, cumbersome operation such as dust collecting filter replacement does not have to be performed, and apparatus configuration also becomes simple.

Moreover, provided to the frame bodies 61 are: an upstream duct 63 of an L shape; and a downstream duct 64 of an I shape. Between one end of the upstream duct 63 (a downstream side of the upstream duct 63: left side of FIG. 4) and one end of the downstream duct 64 (an upstream side of the downstream duct 64: a lower side of FIG. 4), a flow passage V is formed.

The flow passage V is so formed as to extend in an axial direction of the heat roller 18 between the hollow part 51*b* of the holding member 51 and the heater 44, and is connected to the upstream duct 63 and the downstream duct 64.

When air is delivered from the upstream duct 63 in an arrow direction by a fan (not shown), the air flows around the heater 44 in the arrow direction through the flow passage V from the upstream duct 63, and is discharged from the downstream duct 64. Passing the air around the heater 44 through the flow passage V in the axial direction can prevent breakage of the heater 44 and surrounding members of the heater 44 due to an excessive temperature increase of the heater 44. In a case where a temperature detecting sensor is disposed near the heat roller 18 and the temperature detecting sensor detects the excessive temperature increase of the heater 44, the fan may be configured to be driven to deliver air to the flow passage V. With this configuration, the excessive temperature increase of the heater 44 can be suppressed, and the breakage of the heater 44 and the surrounding members of the heater 44 can be prevented.

EXAMPLE 1

By using the image forming apparatus 1 (defined as Example 1) provided with the fixing device 5 of the first embodiment described above and an image forming apparatus 1 (defined as Comparative Example 1) provided with a fixing device 5 where the sealed space S of the first embodiment is not formed, amounts of generated ultrafine particles (UFP) were evaluated. As test procedures for the evaluation, the image forming apparatus 1 is installed in a stainless chamber of 5 ms in volume, inside of the chamber was ventilated with a wind volume of 15 m3/h, and then a predetermined image was printed on paper P by the image forming apparatus 1 for 10 minutes. For 50 minutes after the printing, the image forming apparatus 1 was left in the chamber, and the amount (number) of ultrafine particles (UFP) were measured by a real-time particle analyzer (FMPS: Fast Mobility Particle Sizer) Model 13091 (manufactured by TSI Corporation: Saint Pole, Minn., United States). Table 1 shows integrated values PER10 for the amounts of ultrafine particles (UFP) for the 10 minutes calculated from measurement data. The fixing device 5 where the sealed space S is formed (Example 1) has the smaller integrated value for the amount of ultrafine particles (UFP) than that of Comparative Example 1, providing favorable results.

TABLE 1

| | Integrated value $PER_{10}$ for ultrafine particles (UFP) |
|---|---|
| Example 1 | 1.10E+11 |
| Comparative Example 1 | 2.10E+11 |

INDUSTRIAL APPLICABILITY

This disclosure can use a fixing device using an image forming apparatus such as a copier, a printer, a facsimile, or a composite machine including them and the image forming apparatus provided therewith, and more specifically can use a fixing device that prevents ultrafine particles generated inside the fixing device from diffusing to outside of the fixing device and an image forming apparatus provided therewith.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A fixing device comprising:

a heat source generating infrared rays;

a heating member being heated by the heat source;

a pressure member being brought into pressure-contact with the heating member and forming, a nip part for thermally fixing a non-fixed toner image on a recording medium carrying the non-fixed toner image;

a heat absorption unit being formed on an inner circumferential surface of the heating member and absorbing radiation heat of the heat source;

a holding member having a hollow and cylindrical shape, and being arranged between the heat source and the inner circumferential surface of the heat member, the holding member permitting transmission of infrared rays and having heat resistance; and an end part supporting member supporting the holding member at both axial end parts of the heating member, wherein the heat source is disposed at a hollow part of the holding member, the heat absorption unit opposes an outer circumferential part of the holding member with a gap in-between, and the end part supporting member is fitted between the outer circumferential part of the holding member and the inner circumferential surface of the heating member in the axial direction of end parts of the holding member and end parts of the heat absorption unit whereby the outer circumferential part of the holding member, the inner circumferential surface of the heating member, and the end part supporting member form a sealing space sealing the heat absorption unit.

2. The fixing device according to claim 1, wherein snap rings making contact with the axial direction of end parts of the holding member are disposed on the end part of the supporting member.

3. The fixing device according to claim 1, wherein the holding member has heat resistance to 300 degrees Celsius or above.

4. The fixing device according to claim 1, wherein the holding member has heat resistance to 400 degrees Celsius or above.

5. The fixing device according to claim 1, wherein the holding member is formed of silica glass.

6. A fixing device comprising:

a heat source generating infrared rays;

a heating member being heated by heat source;

a pressure member being brought into pressure-contact with the heating member and forming, a nip part for thermally fixing a non-fixed toner image on a recording medium carrying the non-fixed toner image;

a heat absorption unit being formed on an inner circumferential surface of the heating member and absorbing radiation heat of the heat source;

a holding member having a hollow and cylindrical shape, and being arranged between the heat source and the inner circumferential surface of the heat member, the holding member permitting transmission of infrared rays and having heat resistance; and an end part supporting member supporting the holding member at both axial end parts of the heating member, wherein the heat source is disposed at a hollow part of the holding member, the heat absorption unit opposes an outer circumferential part of the holding member with a gap in-between, and the outer circumferential part of the holding member, the inner circumferential surface of the heating member, and the end part supporting member form a sealed space sealing the heat absorption unit, wherein the heating member is rotatably supported by a frame body as the end part supporting member via a bearing part, the holding member is held by the frame body, and the sealed space is formed by the outer circumferential part of the holding member, the inner circumferential surface of the heating member, and the frame body.

7. The fixing device according to claim 3, wherein between the hollow part of the holding member and the outer side of the heat source, a flow passage passing air in an axial direction of the heating member is provided.

8. An image forming apparatus comprising:

an image formation unit forming a toner image on a recording medium; and a fixing device fixing, onto the recording medium, the toner image formed by the image formation unit, wherein the fixing device comprises:

heat source generating infrared rays;

a heating member being heated by the heat source;

a pressure member being brought into pressure-contact with the heating member and forming, a nip part for thermally fixing a non-fixed toner image on a recording medium carrying the non-fixed toner image;

a heat absorption unit being formed on an inner circumferential surface of the heating member and absorbing radiation heat of the heat source;

a holding member having a hollow and cylindrical shape, and being arranged between the heat source and the inner circumferential surface of the heat member, the holding member permitting transmission of infrared rays and having heat resistance; and an end part supporting member supporting the holding member at both axial end parts of the heating member, wherein the heat source is disposed at a hollow part of the holding member, the heat absorption unit opposes an outer circumferential part of the holding member at with a gap in-between, and the end part supporting member is fitted between the outer circumferential part of the holding member and the inner circumferential surface of the heating member in the axial direction of end parts of the holding member and end parts of the heat absorption unit whereby the outer circumferential part of the holding member, the inner circumferential surface of the heating member, and the end part supporting member form a sealing space sealing the heat absorption unit.

9. The image forming apparatus according to claim 8, wherein the holding member has heat resistance to 300 degrees Celsius or above.

* * * * *